US011850467B2

(12) United States Patent
Alford

(10) Patent No.: US 11,850,467 B2
(45) Date of Patent: Dec. 26, 2023

(54) FITNESS GRIP

(71) Applicant: Rodney Alford, Kernersville, NC (US)

(72) Inventor: Rodney Alford, Kernersville, NC (US)

( * ) Notice: Subject to any disclaimer, the term of this patent is extended or adjusted under 35 U.S.C. 154(b) by 189 days.

(21) Appl. No.: 17/506,732

(22) Filed: Oct. 21, 2021

(65) Prior Publication Data

US 2022/0134176 A1 May 5, 2022

Related U.S. Application Data

(60) Provisional application No. 63/107,472, filed on Oct. 30, 2020.

(51) Int. Cl.
*A63B 21/00* (2006.01)
*A63B 21/04* (2006.01)
*A63B 21/055* (2006.01)

(52) U.S. Cl.
CPC ..... *A63B 21/4035* (2015.10); *A63B 21/0442* (2013.01); *A63B 21/0557* (2013.01)

(58) Field of Classification Search
CPC ..... A63B 21/4035; A63B 21/0442; A63B 21/0557; A63B 21/00061; A63B 21/0555; A63B 21/0552
See application file for complete search history.

(56) References Cited

U.S. PATENT DOCUMENTS 3,427,023 A * 2/1969 Silberman ..... A63B 21/0552 482/126
7,316,636 B1 * 1/2008 Hinds ..... A63B 21/0552 482/44
7,326,157 B2 * 2/2008 Wu ..... A63B 21/0552 482/121
D616,950 S * 6/2010 Hersee ..... D8/303
7,736,284 B1 * 6/2010 Andrews ..... A63B 21/072 482/92
8,128,541 B2 * 3/2012 Hartman ..... A63B 21/4017 482/122
8,235,872 B2 8/2012 Perry
D688,338 S * 8/2013 Bisson ..... D21/694
8,500,609 B1 8/2013 Williams
8,782,854 B1 7/2014 Samuels
D721,773 S * 1/2015 Marooth ..... A63B 21/0004 D21/694

(Continued)

FOREIGN PATENT DOCUMENTS

GB 2506189 A 3/2014
GB 2577059 A 3/2020

*Primary Examiner* — Andrew S Lo

(57) ABSTRACT

A Fitness Grip that is designed to mimic the feel of a weight lifting bar is provided for use with exercise stretch bands. The Fitness Grip has a cylindrical grip element with flanged ends and a slot for receiving the exercise stretch band. The Fitness Grip is formed as a one piece monolithic grip element or as a rigid inner core with a pliant outer molded covering. The one piece grip element or outer molded covering may be molded from 90 durometer hardness urethane rubber. The slot may have tooth-like gripping features or retaining features adjoining the flanged ends. The slot may penetrate the cylindrical grip element to within ¼ inch of the surface of the cylindrical grip element opposite the slotted opening. The ends of the slot adjoining the outer faces of the flanged ends may be provided with fillet radii.

10 Claims, 13 Drawing Sheets

(56) References Cited

U.S. PATENT DOCUMENTS

| | | | | |
|---|---|---|---|---|
| 8,932,191 | B2 | 1/2015 | Failer et al. | |
| 9,011,304 | B2 | 4/2015 | Gillman | |
| D739,484 | S * | 9/2015 | Kaye | D21/694 |
| D778,378 | S * | 2/2017 | Schultz | A63B 21/026 D21/694 |
| 9,907,993 | B2 | 3/2018 | Penney | |
| 10,806,987 | B2 * | 10/2020 | Burns | A63B 21/4035 |
| 11,033,774 | B1 * | 6/2021 | Clarke | A63B 21/00185 |
| 11,266,870 | B2 * | 3/2022 | Leadbetter | A63B 21/0724 |
| D958,272 | S * | 7/2022 | Leclair | A63B 21/0552 D21/694 |
| 2008/0040891 | A1 * | 2/2008 | Tyler | A63B 21/4017 16/421 |
| 2009/0197742 | A1 * | 8/2009 | Hartman | A63B 21/026 482/92 |
| 2009/0275448 | A1 * | 11/2009 | Fishman | A63B 21/072 482/139 |
| 2011/0098159 | A1 | 4/2011 | Wiseman | |
| 2012/0179226 | A1 * | 7/2012 | Graham | A63B 21/0004 607/111 |
| 2014/0024508 | A1 * | 1/2014 | Hinds | A63B 21/02 482/129 |
| 2014/0228180 | A1 * | 8/2014 | Walker | A63B 21/0557 482/82 |
| 2016/0158594 | A1 * | 6/2016 | Penney | A63B 21/4035 264/331.13 |
| 2017/0182348 | A1 * | 6/2017 | Bertolutti | A63B 21/4035 |
| 2017/0282000 | A1 * | 10/2017 | Dorsey | A63B 21/4013 |
| 2019/0001211 | A1 | 1/2019 | Burns | |
| 2019/0059568 | A1 * | 2/2019 | Orlando | A46B 7/042 |
| 2021/0354000 | A1 * | 11/2021 | Alba | A61H 15/0092 |

* cited by examiner

FITNESS GRIP

CROSS-REFERENCE TO RELATED APPLICATIONS

The present application claims priority to U.S. Provisional No. 63/107,472, filed Oct. 30, 2020, the entire contents of all of which are herein incorporated by reference.

BACKGROUND

Field of Invention

Embodiments of the present invention described herein generally relate to a Fitness Grip. The Fitness Grip is designed to be compatible with various types of exercise stretch bands. The Fitness Grip mimics the feeling of a weight-lifting bar when used with exercise stretch bands.

Related Art

Exercise stretch bands, sometimes referred to as resistance bands, are widely used in physical therapy and in physical training. They provide many advantages over weights, such as flexibility in use, being lightweight, and providing progressively increasing resistance. These characteristics allow for controlled rehabilitation and improvement of strength and motion. Moreover, they are generally safer to use than free weights or weight machines, as there is little possibility of injury due to being dropped or loss of control as there is with free weights or weight machines.

However, exercise stretch bands can be difficult and uncomfortable to hang onto. Often, those using exercise stretch bands have physical and/or dexterity limitations, which further exacerbates this difficulty. In particular, as the exercise stretch band is used, it naturally stretches and relaxes, including the portion of the exercise stretch band in contact with the users hand or hands. This results in sliding contact between the exercise stretch band and the hand, as well as a sensation of pinching as the exercise stretch band contracts. In order to counteract this, users of exercise stretch bands often wear gloves to eliminate the discomfort.

Accordingly, there is an unmet need for a solution that eliminates direct contact between exercise stretch bands and users' hands when in use. There is further an unmet need for a solution that makes the use of exercise stretch bands easier and more comfortable, particularly for users having physical and/or dexterity limitations.

SUMMARY

Embodiments described herein relate to a Fitness Grip that is designed to mimic the feel of a weight-lifting bar when used with exercise stretch bands. The Fitness Grip of the present invention is formed as a solid cylindrical grip element having flanged ends and a slot for receiving the exercise stretch band. The term "solid cylindrical" as used in describing the present invention means a cylinder that is not hollow, i.e.—that is filled-in or monolithic except for the slot. The solid cylindrical grip element of the Fitness Grip may have a diameter at its gripping surface of about 1½ inches, for non-limiting example, thereby being comfortable to grasp. The solid cylindrical grip element of the Fitness Grip may be provided with flanges at each end in order to prevent users' hands from slipping off the end of the solid cylindrical grip element and to provide additional stability and strength. The solid cylindrical grip element of the Fitness Grip may be formed as a solid one-piece element, for non-limiting example, molded from 90 durometer hardness urethane rubber. Alternately, the solid cylindrical grip element of the Fitness Grip may be formed having a solid cylindrical rigid inner core with a pliant outer molded covering, again for non-limiting example, molded from 90 durometer hardness urethane rubber. The solid cylindrical grip element of the Fitness Grip may be provided with a textured gripping surface, for non-limiting example, a honeycomb pattern, a repeating impressed or embossed knurl or other pattern, grooves, and etcetera.

The solid cylindrical grip element of the Fitness Grip is provided with a slot having a slotted opening to receive an exercise stretch band. The slot runs the full length of the solid cylindrical grip element. The slot may penetrate the solid cylindrical grip element at least to the centerline of the cylinder, and in some embodiments to a large fraction of the diameter of the solid cylindrical grip element, for non-limiting example to within ¼ inch of the surface of the solid cylindrical grip element opposite the slotted opening. In an embodiment of the Fitness Grip having a solid cylindrical rigid inner core with a pliant outer molded covering, the depth of the slot may or may not penetrate all the way through the solid cylindrical rigid inner core. The ends of the slot adjoining the end faces of the Fitness Grip may be provided with a fillet radius, in order to prevent "pinch points" upon the exercise stretch band, thereby limiting stress concentration within and breakage of the exercise stretch band. Retaining features may be provided adjoining the flanges at each end of the solid cylindrical grip element, which may be formed as hemicylindrical features that extend at least partially over the ends of the slotted opening. The retaining features with their half round radii allow for easy insertion of the exercise stretch band, and help to keep the exercise stretch band from slipping out of the slot during use.

The slot of the Fitness Grip can accommodate the four most common flat exercise stretch bands, which are often color coded yellow for 6.4 mm wide having 5 to 15 pounds resistance, red for 13 mm wide having 15 to 35 pounds resistance, black for 22 mm wide having 25 to 65 pounds resistance, and purple for 32 mm wide having 35 to 85 pounds resistance. The slot of the Fitness Grip can also accommodate commonly used tube bands, which may be flattened before being inserted into the slotted opening of the Fitness Grip. The slot of the Fitness Grip may further be provided with tooth-like gripping features in order to better grip the exercise stretch band.

The Fitness Grip of the present invention may be of virtually any dimension compatible with normal human grip ranges. Preferably, the Fitness Grip of the present invention may be about 4½ inches to about 5⅝ inches long, about 4 inches to about 4⅜ inches long at the gripping surface, with an about ¼ inch to about ⅝ inch flange at each end. The Fitness Grip of the present invention may be about 1½ inches in diameter at the gripping surface, about 1¾ inches to about 2 inches in diameter at the flanges, having gripping surface features, for non-limiting example hexagonal honeycomb elements that are approximately ½" wide and 1/16" deep. The flanges may have approximately 23/64" outer profile radii. The slotted opening may be about 9/64 inch to about 9/32 inch wide. The depth of the slot may be to within about ¼ inch and no less than about 3/16 inch of the overall diameter of the gripping surface. Within the slot, the tooth-like gripping features may be characterized as about ⅛ inch wide grooves, being about 1/16 inch in depth, both lateral and longitudinal, for non-limiting example. The retaining features adjoining the flanges at each end of the solid cylindrical grip element, may be about ⅛ inch in radius, and the radius in the ends of the slot to prevent "pinch points" on the band may be about 1/32 inch in radius.

According to one embodiment of the Fitness Grip, a solid cylindrical grip element has flanged ends and a slot with a slotted opening for receiving an exercise stretch band.

According to another embodiment of the Fitness Grip, an exercise apparatus includes at least one exercise stretch band and a solid cylindrical grip element. The solid cylindrical grip element has flanged ends and a slot with a slotted opening for receiving the at least one exercise stretch band.

According to another embodiment of the Fitness Grip, a facility for exercising includes a building having at least one exercise stretch band located within the building. A solid cylindrical grip element has flanged ends and a slot with a slotted opening for receiving the at least one exercise stretch band.

DESCRIPTION OF THE DRAWINGS

The above-mentioned and other features of embodiments of the Fitness Grip, and the manner of their working, will become more apparent and will be better understood by reference to the following description of embodiments of the Fitness Grip taken in conjunction with the accompanying drawings, wherein:

FIG. 76 is a longitudinal section view taken along line C-C of FIG. 4 of an embodiment of the Fitness Grip of the present invention, as described herein;

Corresponding reference numbers indicate corresponding parts throughout the several views. The exemplifications set out herein illustrate embodiments of the Fitness Grip, and such exemplifications are not to be construed as limiting the scope of the claims in any manner.

DETAILED DESCRIPTION

Figure 1:
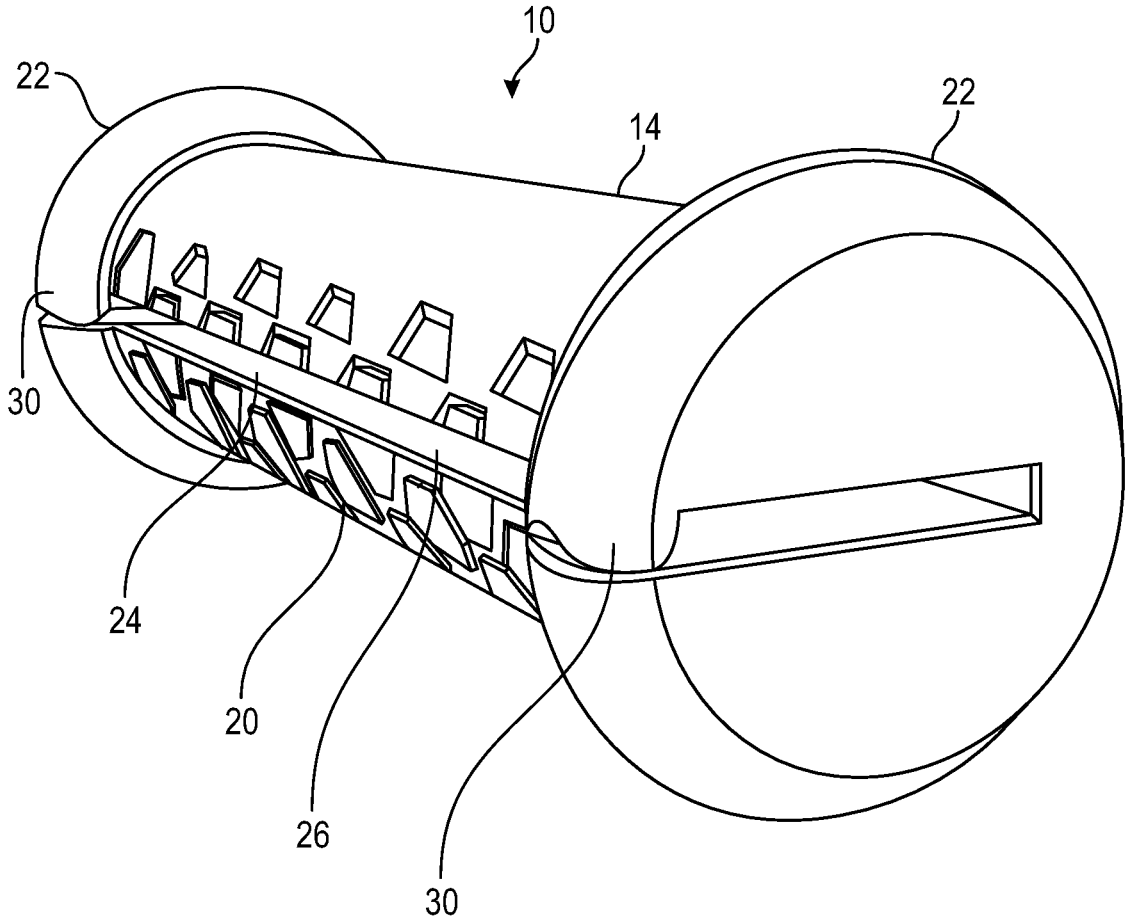
FIG. 1 is an isometric end view of an embodiment of the Fitness Grip of the present invention, as described herein.
Figure 2:
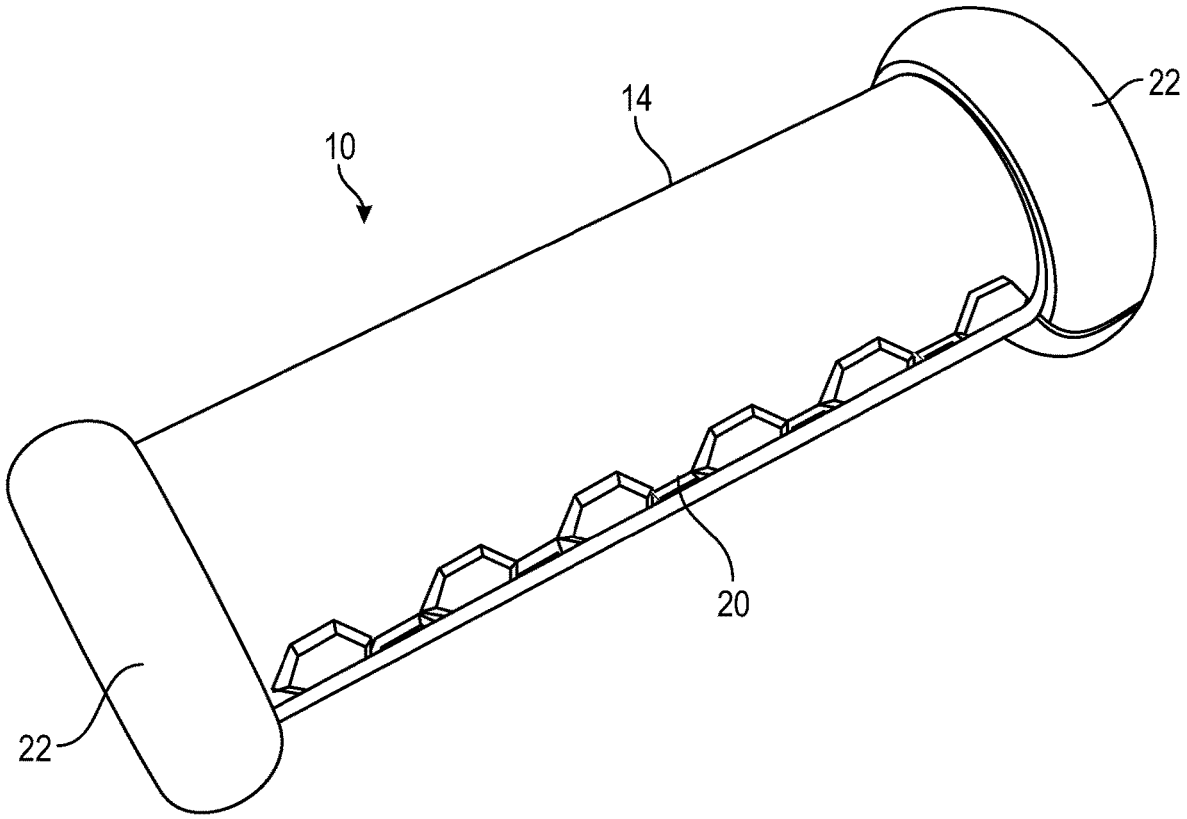
FIG. 2 is an isometric front view of an embodiment of the Fitness Grip of the present invention, as described herein.
Figure 3:
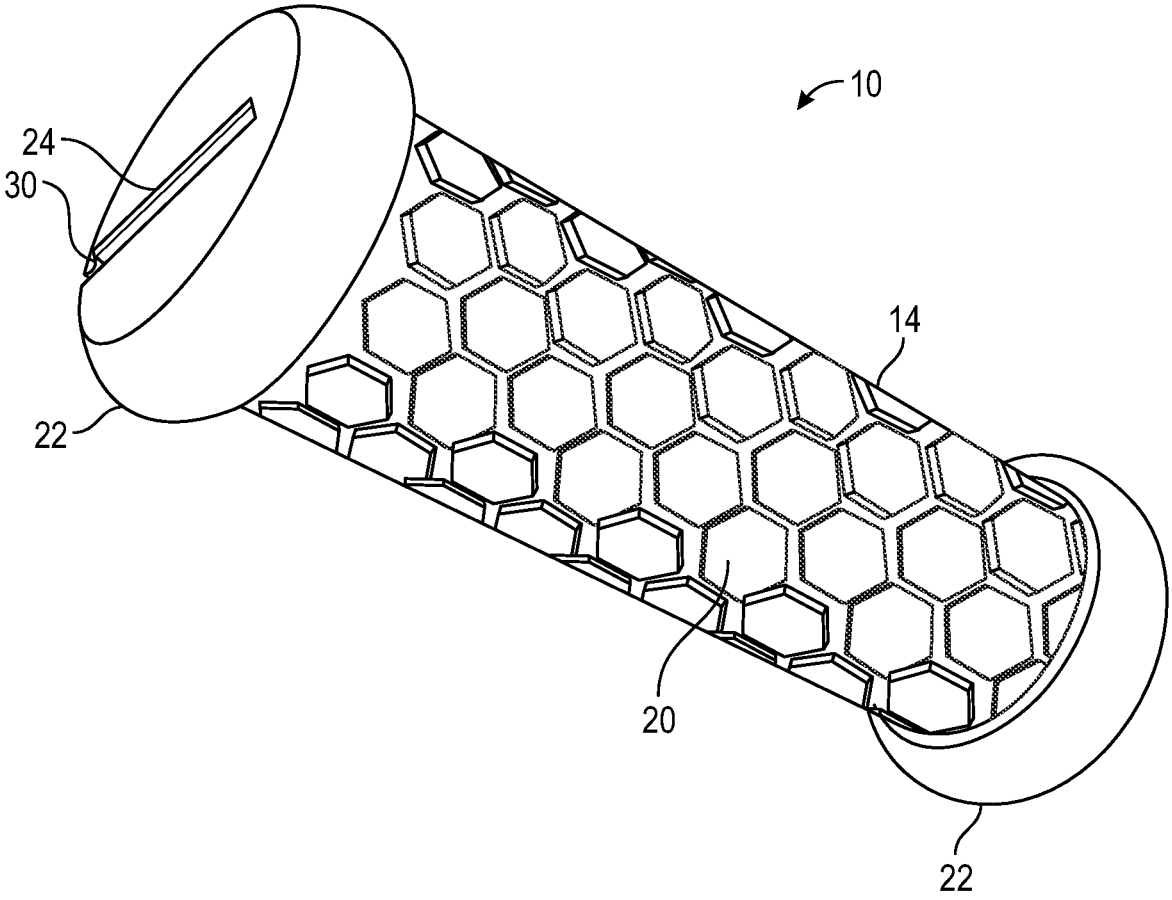
FIG. 3 is an isometric rear view of an embodiment of the Fitness Grip of the present invention, as described herein.

The following detailed description and appended drawing describe and illustrate various exemplary embodiments of the invention. The description and drawings serve to enable one skilled in the art to make and use the invention, and are not intended to limit the scope of the invention in any manner. In respect of any methods disclosed and illustrated, the steps presented are exemplary in nature, and thus, the order of the steps is not necessary or critical.

Turning now to FIGS. 1 through 5, a non-limiting exemplary embodiment of the Fitness Grip 10 is shown. The Fitness Grip 10 is formed as a solid cylindrical grip element 14 having a flange 22 at each end. Formed into the surface of the solid cylindrical grip element 14 is a textured gripping surface 20. The textured gripping surface 20 and the flanges 22 cooperate to prevent a user's hands from slipping off from the Fitness Grip 10 in use. A slot 24 having a slotted opening 26 is provided to receive an exercise band. The slot 24 has at its ends filleted radii to prevent pinching and breakage of the exercise band. The flanges 22 are further provided with retaining features 30 in the form of hemicylindrical extensions that extend at least partially over the ends of the slotted opening 26. The retaining features 30 further prevent the exercise band from falling out of the slot 24 in use.

Figure 4:
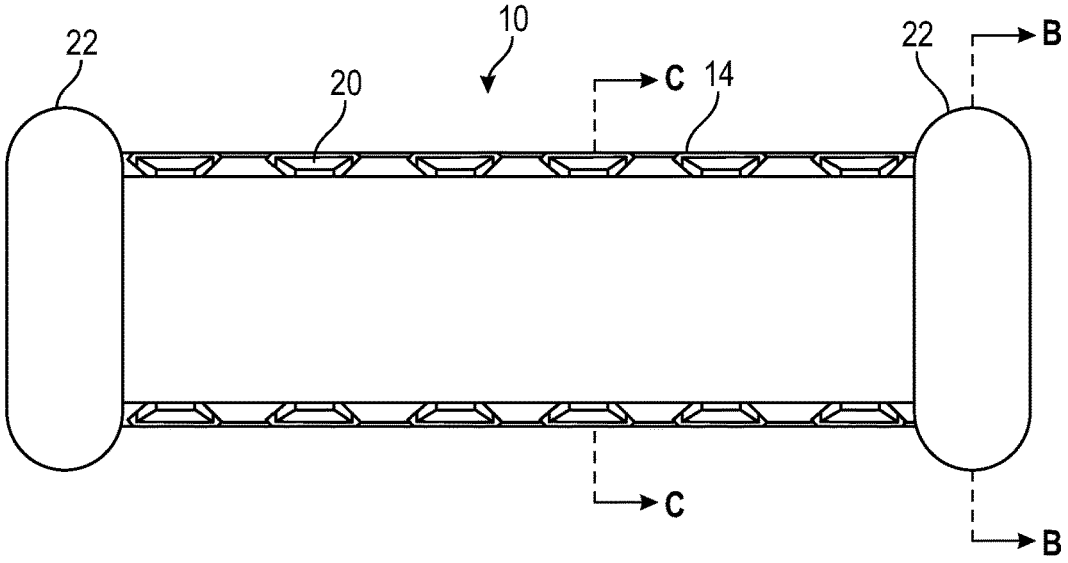
FIG. 4 is a top view of an embodiment of the Fitness Grip of the present invention, as described herein.
Figure 5:
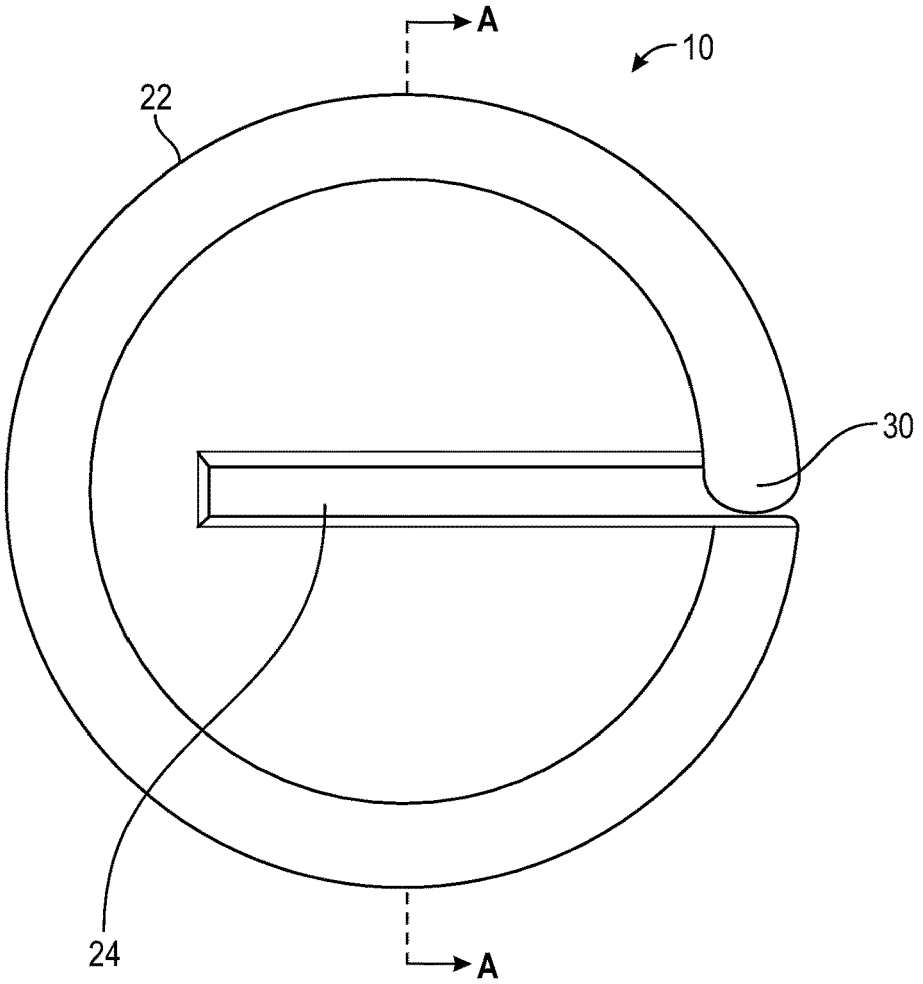
FIG. 5 is an end view of an embodiment of the Fitness Grip of the present invention, as described herein.
Figure 6:
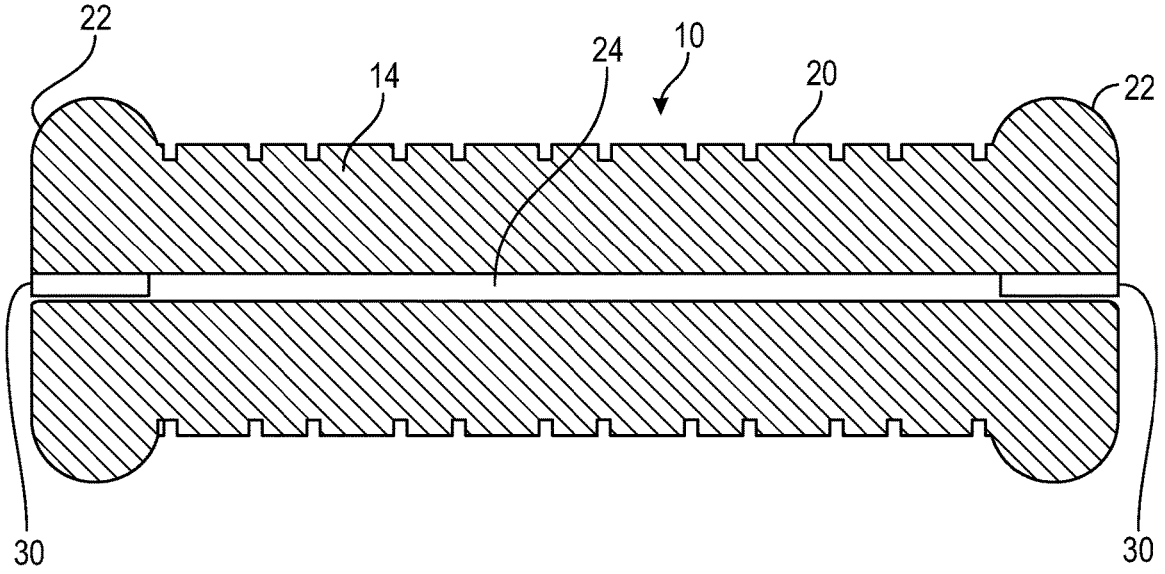
FIG. 6 is a lateral section view taken along line A-A of FIG. 5 of an embodiment of the Fitness Grip of the present invention, as described herein.
Figure 7A:
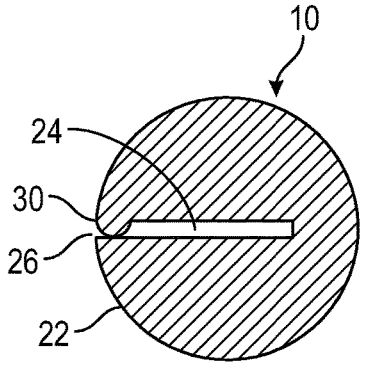
FIG. 7A is a longitudinal section view taken along line B-B of FIG. 4 of an embodiment of the Fitness Grip of the present invention, as described herein.

Turning now to FIG. 6, a section view of the Fitness Grip 10 is shown along section line A-A in FIG. 5. The solid cylindrical grip element 14 and flanges 22 are shown in profile. Retaining features 30 extend into the slot 24 and adjoin the flanges 22. The grooves and lands of the textured gripping surface 20 are also visible. FIG. 7A shows a section view of the Fitness Grip 10 along section line B-B in FIG. 4. The section view is taken at about the middle of the flange 22 so that details of the retaining feature 30 that extends into the slotted opening 26 of the slot 24 are visible. As may be seen the retaining feature 30 is formed as a hemicylindrical extension of the end of the flange 22 adjoining the slotted opening 26.

Figure 7B:
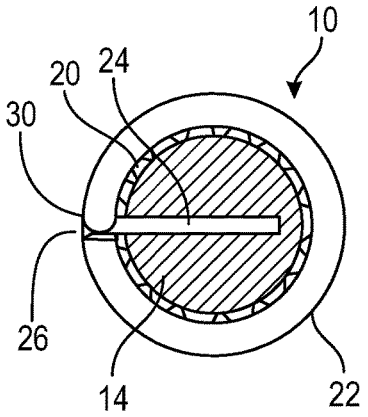
FIG. 7C is a longitudinal section view taken along line C-C of FIG. 4 of an alternate embodiment of the Fitness Grip of the present invention, as described herein.
Figure 7C:
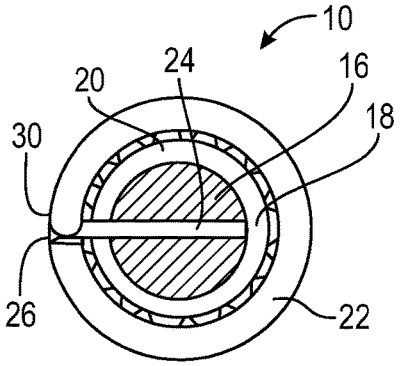

FIGS. 7B and 7C show a section view of a first and second embodiment, respectively, of the Fitness Grip 10 along section line B-B in FIG. 4. In the embodiment shown in FIG. 7B, the Fitness Grip 10 is formed as a solid cylindrical grip element 14, for non-limiting example, molded from 90 durometer hardness urethane rubber. The slot 24 is again provided having a slotted opening 26 to receive an exercise band, which slot 24 has a depth extending to within a small distance, for non-limiting example about ¼ inch and no less than about 3/16 inch, of the overall diameter of the solid cylindrical grip element 14. In the embodiment shown in FIG. 7C, the Fitness Grip 10 is formed with a solid cylindrical rigid inner core 16 and a pliant outer molded covering 18. The slot 24 is again provided having a slotted opening 26 to receive an exercise band, which slot 24 has a depth extending in this embodiment entirely through the solid cylindrical rigid inner core 16, so that the solid cylindrical rigid inner core 16 is embodied as two hemicylindrical halves. The pliant outer molded covering 18 then effectively functions as a living hinge at the bottom of the slot 24, thereby more effectively gripping the exercise stretch band inserted therein in use.

The Fitness Grip 10 of either embodiment shown in FIG. 7B or 7C is again provided with flanges 22 at each end of the solid cylindrical grip element 14 or solid cylindrical rigid inner core 16 and pliant outer molded covering 18. The flanges 22 again provided with retaining features 30 in the form of hemicylindrical extensions that extend at least partially over the ends of the slotted opening 26. The retaining features 30 further prevent the exercise band from falling out of the slot 24 in use. A textured gripping surface 20 and the flanges 22 again cooperate to prevent a user's hands from slipping off from the Fitness Grip 10 in use.

Figure 9:
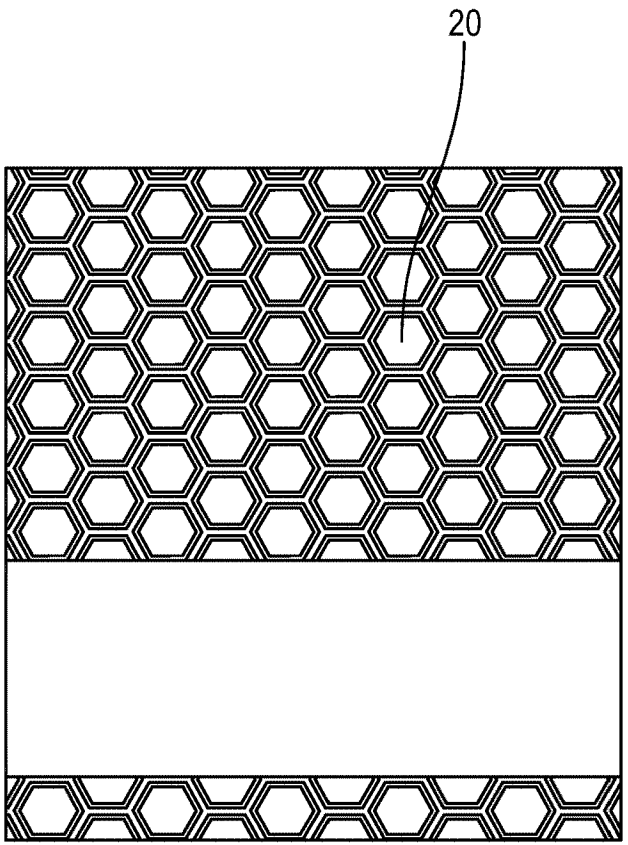
FIG. 9 is an illustration of a textured gripping surface of an embodiment of the Fitness Grip of the present invention, as described herein.
Figure 8:
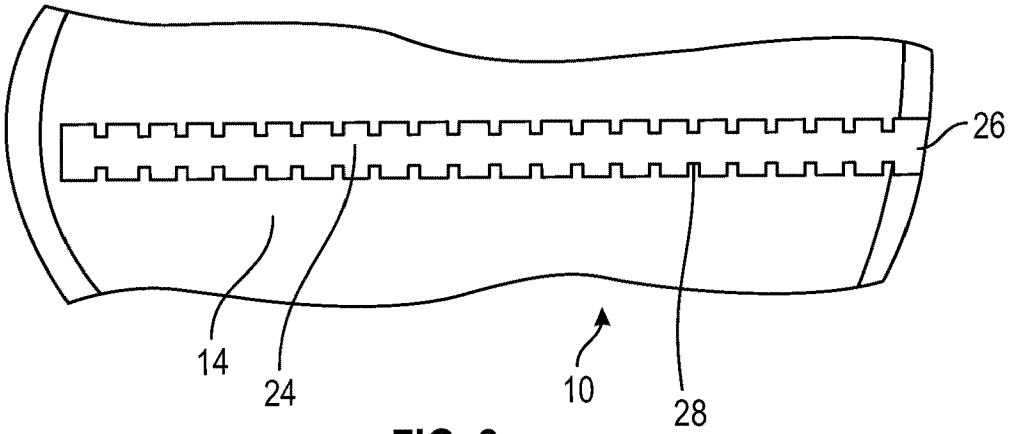
FIG. 8 is a partial detail view of a slot of an embodiment of the Fitness Grip of the present invention, as described herein.

FIG. 8 shows a partial detail view of a Fitness Grip 10 embodied as a solid cylindrical grip element 14 having a slot 24 with a slotted opening 26. Gripping features 28 are provided within the slot 24 to allow the user to more effectively grip the exercise stretch band by squeezing the solid cylindrical grip element 14, which may again be formed from, for non-limiting example, molded 90 durometer hardness urethane rubber. Alternatively, if the Fitness Grip 10 is embodied having a solid cylindrical rigid inner core 16 and a pliant outer molded covering 18, then the gripping features 28 may be formed in the inner surfaces of the two hemicylindrical halves of the solid cylindrical rigid inner core 16. In either representative embodiment, the gripping features 28 may be embodied, for non-limiting example, as tooth-like gripping features having about ⅛ inch wide grooves and being about 1/16 inch in depth, extending both lateral and longitudinal. FIG. 9 shows a detail view of and embodiment of the textured gripping surface 20 of the Fitness Grip 10. The textured gripping surface 20 shown in FIG. 9 is embodied, for non-limiting example, as hexagonal honeycomb elements that are approximately ½" wide and 1/16" deep.

Figure 10:
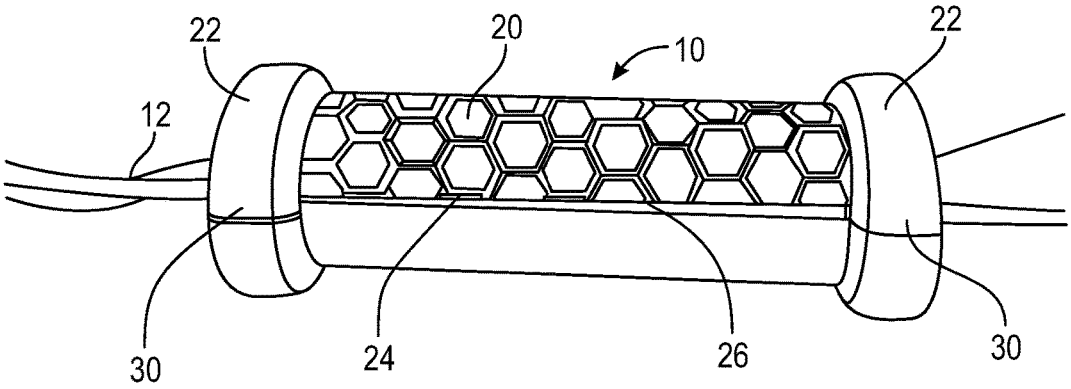
FIG. 10 is a view of an embodiment of the Fitness Grip of the present invention engaged with an exercise band, as described herein.
Figure 11:
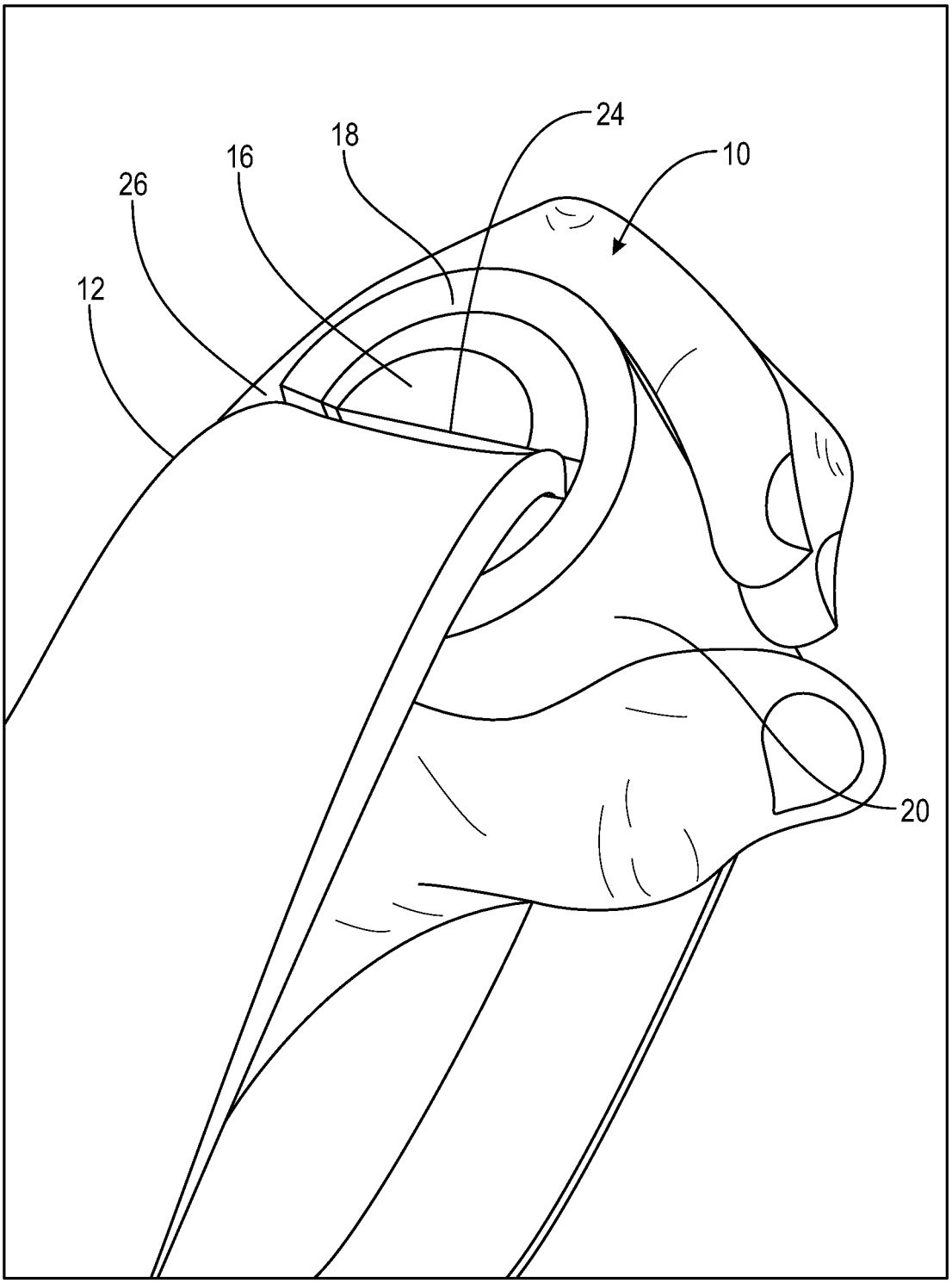
FIG. 11 is an isometric end view of an embodiment of the Fitness Grip of the present invention engaged with an exercise band, as described herein.

Turning now to FIG. 10, an embodiment of the Fitness Grip 10 of the present invention is shown engaged with an exercise stretch band 12. The exercise stretch band 12 has been inserted into the slot 24 by way of the slotted opening 26. The retaining features 30, which again adjoin the flanges 22 help to prevent the exercise stretch band 12 from slipping out of the slot 24, while the flanges 22 and the textured gripping surface 20 help to prevent the user's hand from slipping off from the Fitness Grip 10 when in use. FIG. 11 shows another embodiment of the Fitness Grip 10 of the present invention engaged with an exercise stretch band 12. The flanges 22 (not shown) have been cut away to show the solid cylindrical rigid inner core 16 and the pliant outer molded covering 18. The exercise stretch band 12 has again been inserted into the slot 24 by way of the slotted opening 26. The textured gripping surface 20 is visible on the outer surface of the pliant outer molded covering 18.

Figure 13:
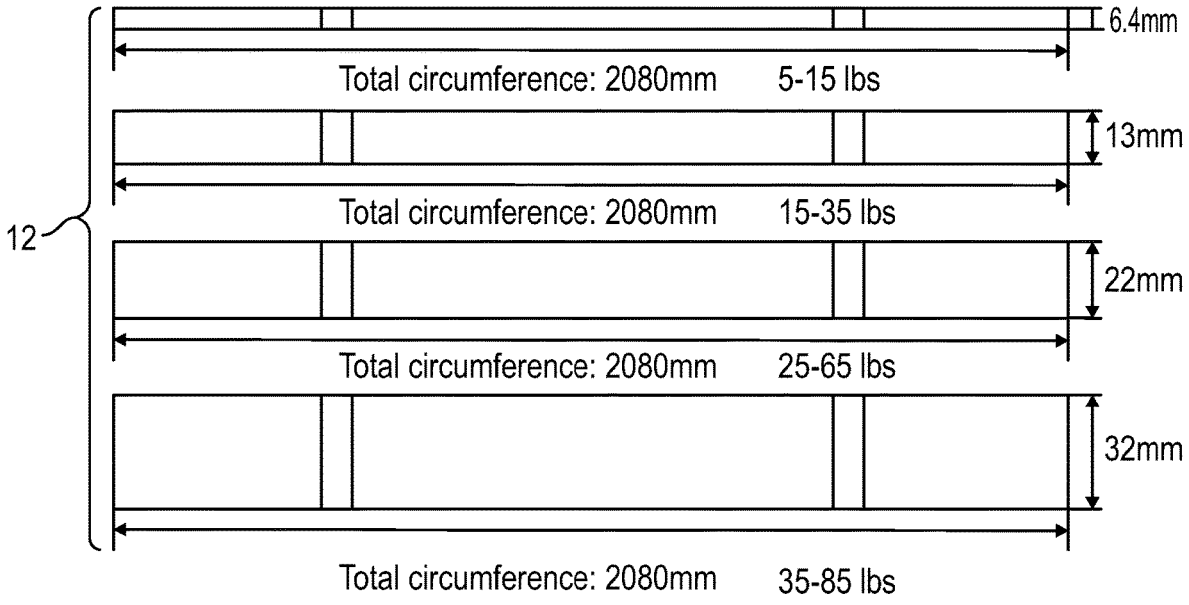
FIG. 13 is a view of common exercise bands that may be used with the Fitness Grip of the present invention, as described herein.
Figure 12:
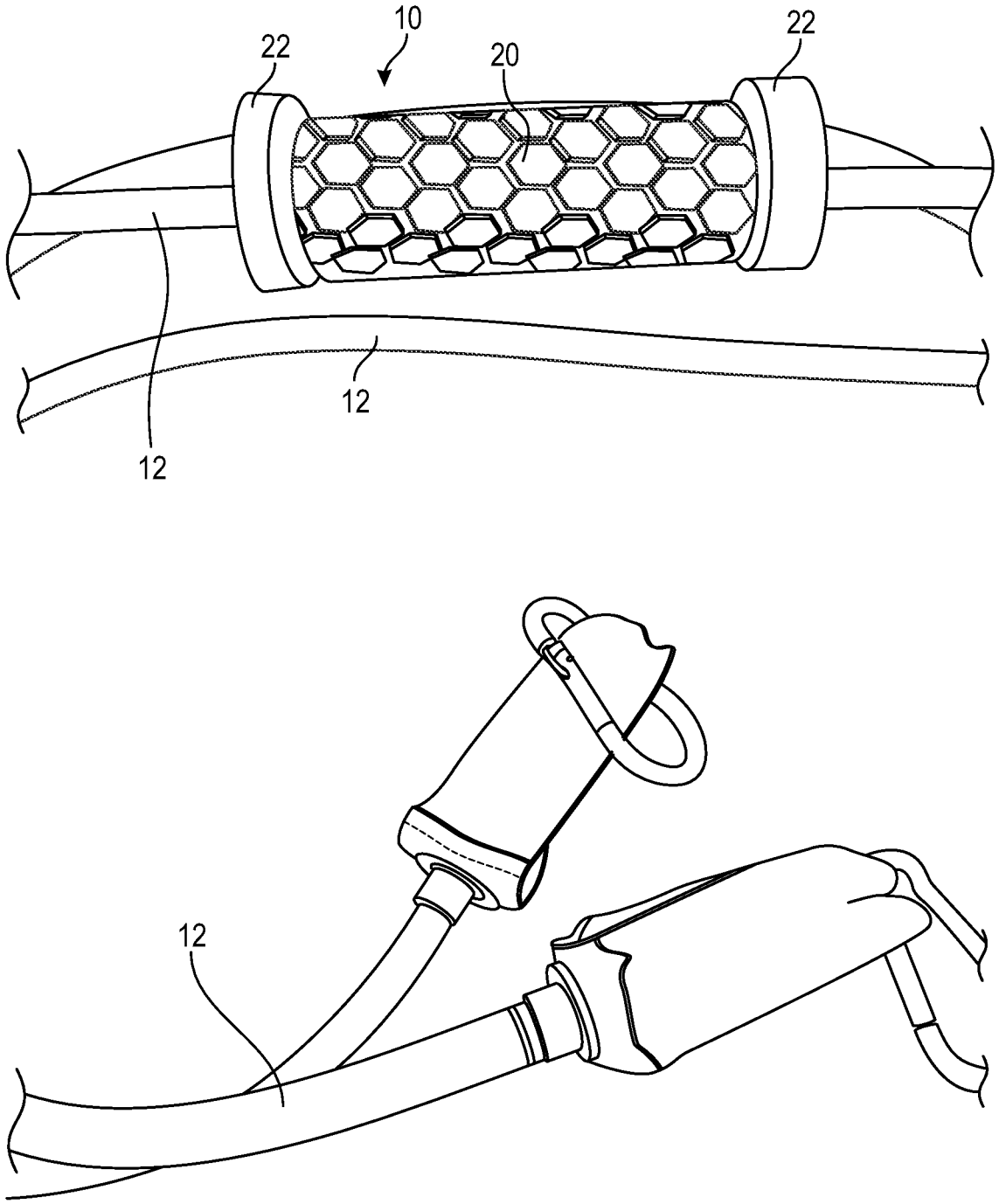
FIG. 12 is a view of an embodiment of the Fitness Grip of the present invention engaged with an exercise band, as described herein.
Figure 14:
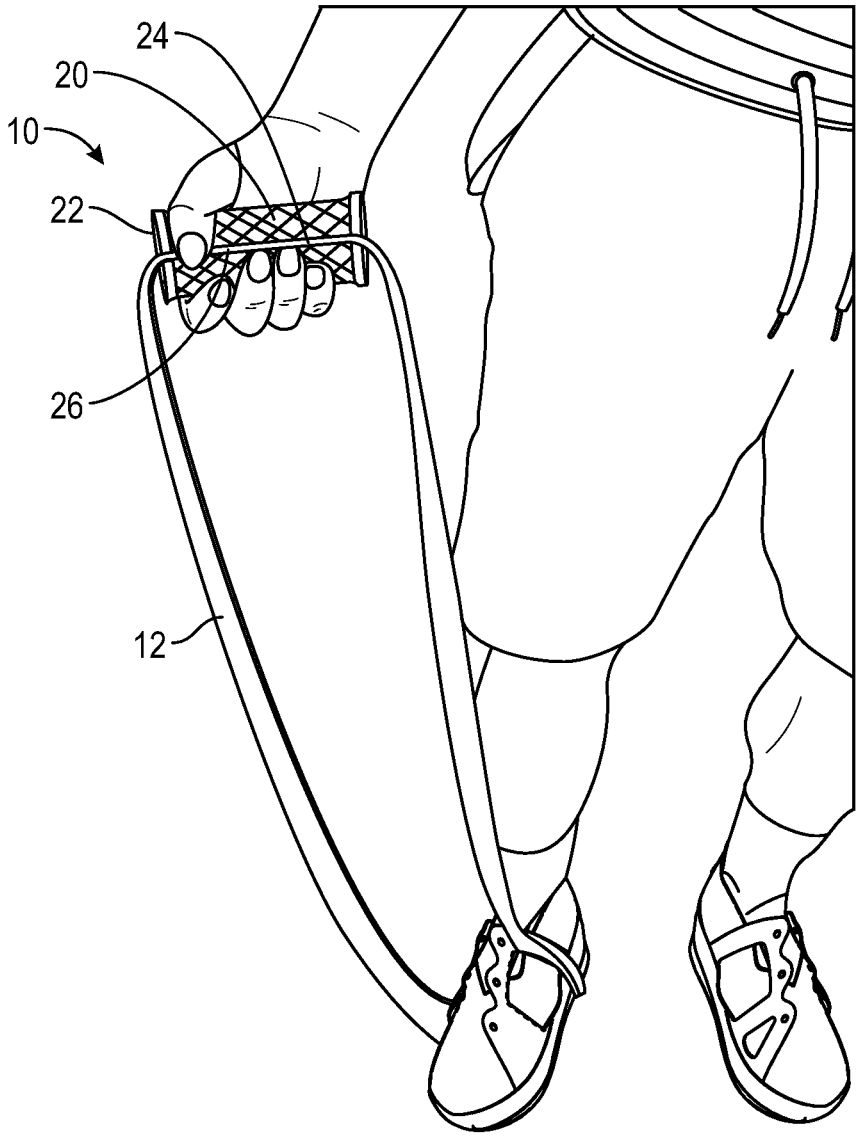
FIG. 14 is a view an embodiment of the Fitness Grip of the present invention in use, as described herein.
Figure 15:
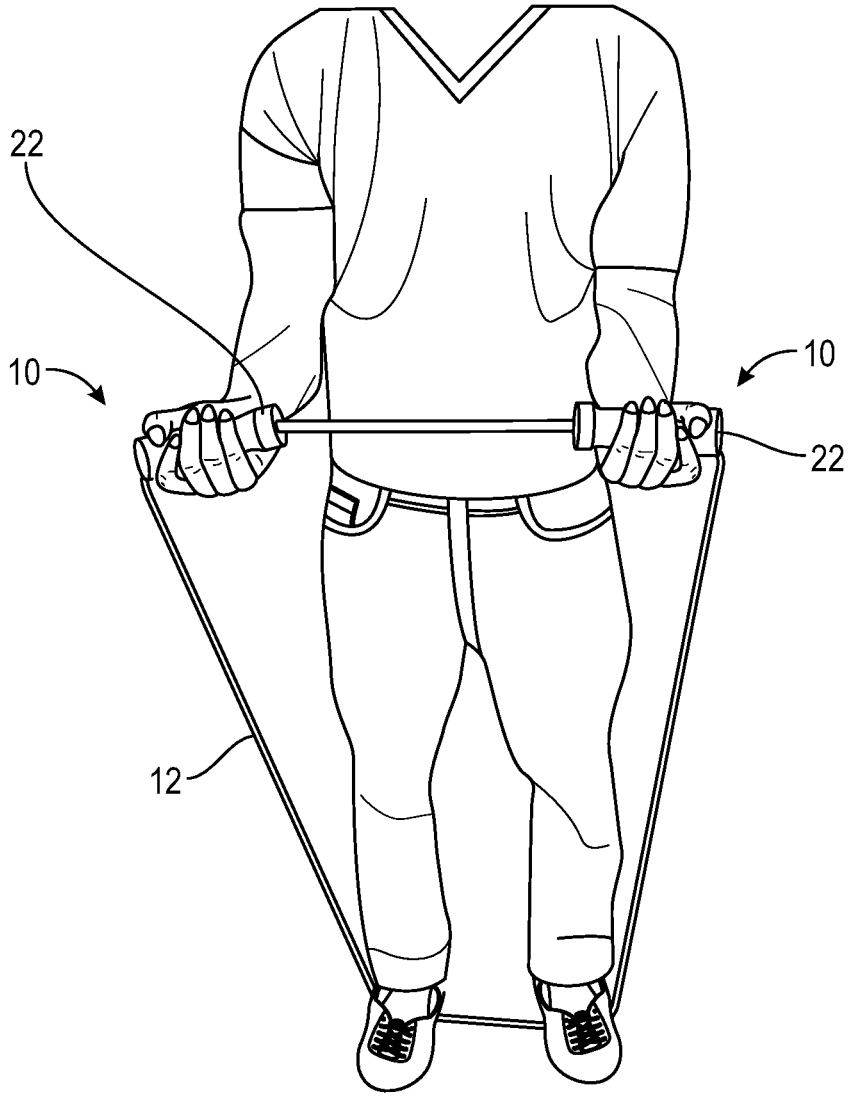
FIG. 15 is a view an embodiment of the Fitness Grip of the present invention in use, as described herein.
Figure 16:
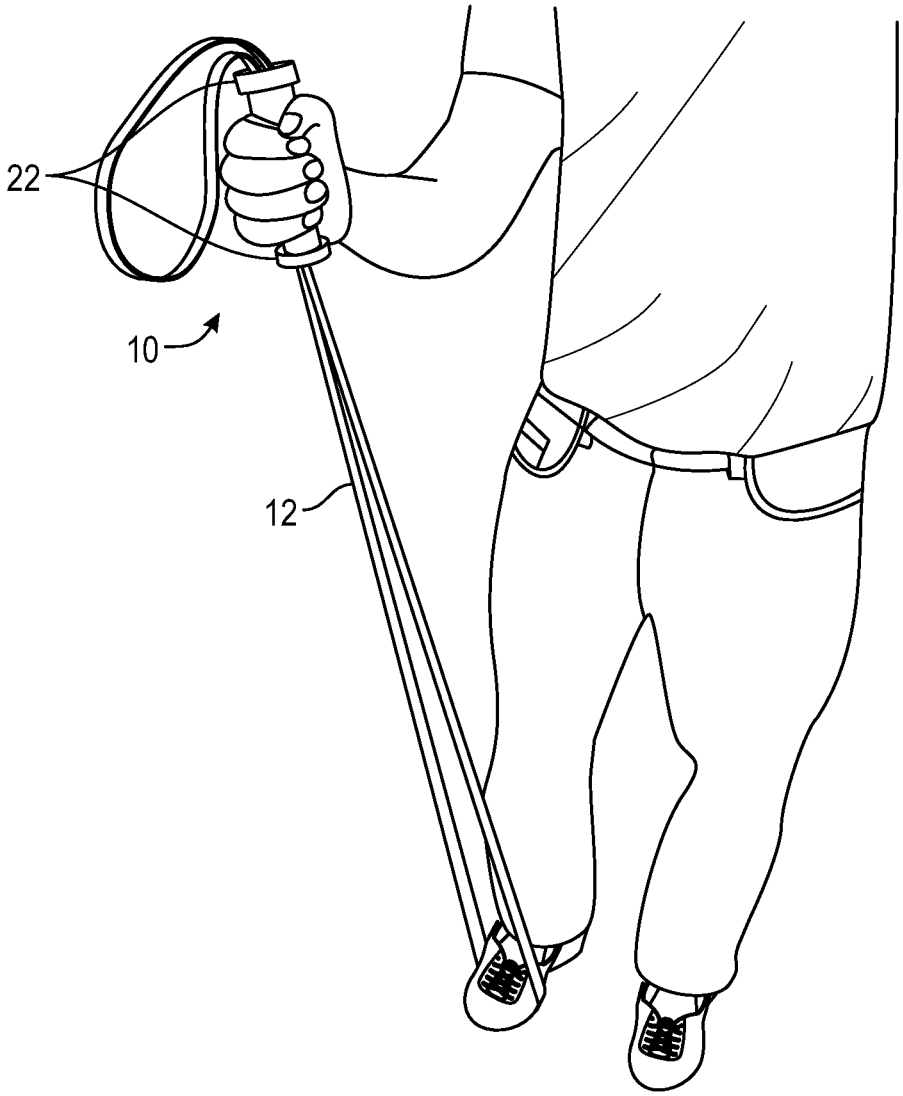
FIG. 16 is a view an embodiment of the Fitness Grip of the present invention in use, as described herein.
Figure 17:
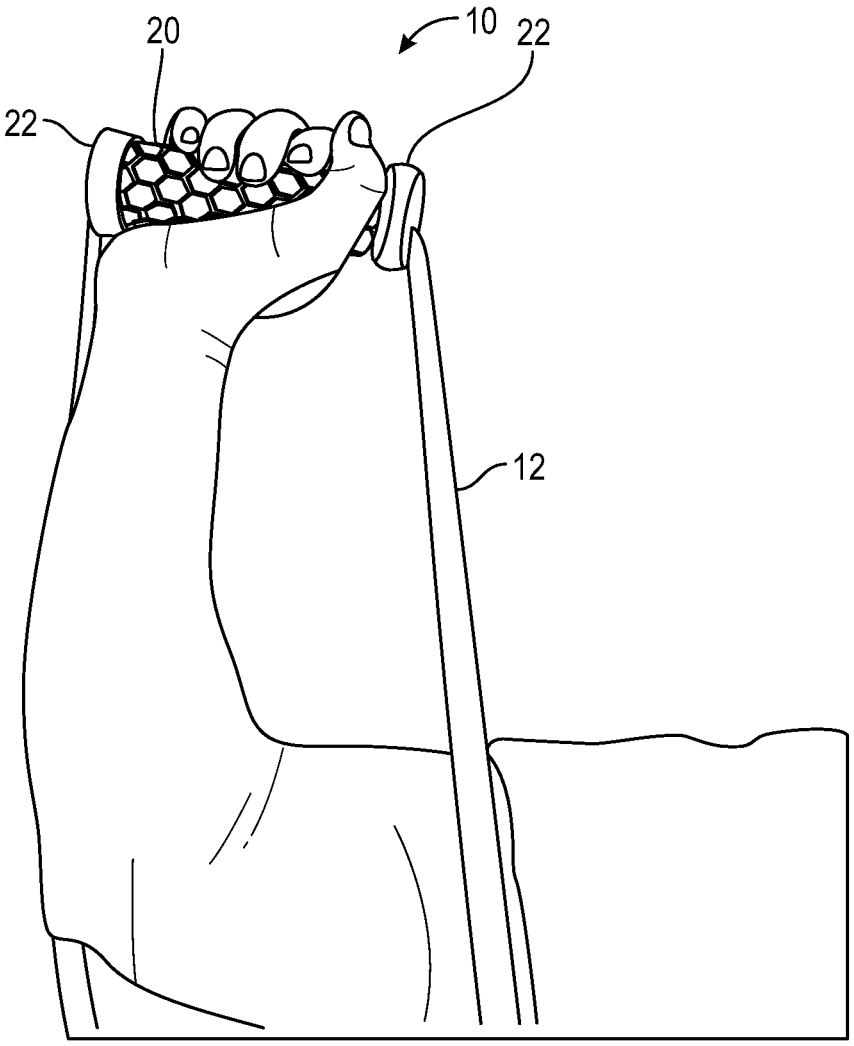
FIG. 17 is a view an embodiment of the Fitness Grip of the present invention in use, as described herein.

Turning now to FIGS. 12 and 13 various exercise stretch bands 12 are shown being compatible with the Fitness Grip 10. In FIG. 12, the several exercise stretch bands 12 shown are tubular, rather than flat. In this case, the tubular exercise stretch bands 12 may be flattened for the purpose of inserting them into the slotted opening 26 of the slot 24. FIG. 13 shows the four most common flat exercise stretch bands, which are often color coded yellow for 6.4 mm wide having 5 to 15 pounds resistance, red for 13 mm wide having 15 to 35 pounds resistance, black for 22 mm wide having 25 to 65 pounds resistance, and purple for 32 mm wide having 35 to 85 pounds resistance.

Turning now to FIGS. 14 through 17 an embodiment of the Fitness Grip 10 of the present invention is shown being used with an exercise stretch band 12. The exercise stretch band 12 is again inserted into the slot 24 by way of the slotted opening 26, so that the Fitness Grip 10 functions to mimic the feel of a weight-lifting bar when used with the exercise stretch band 12. The retaining features 30 (not visible) and the gripping features 28 (not visible) cooperate to securely hold the exercise stretch band 12 within the slot 24, while the textured gripping surface 20 and the flanges 22 cooperate to prevent the user's hands from sliding off from the Fitness Grip 10. FIGS. 14 through 17 show the Fitness Grip 10 in use in various exercises.

While the Fitness Grip has been described with respect to at least one embodiment, the Fitness Grip can be further modified within the spirit and scope of this disclosure, as demonstrated previously. This application is therefore intended to cover any variations, uses, or adaptations of the Fitness Grip using its general principles. Further, this application is intended to cover such departures from the present disclosure as come within known or customary practice in the art to which the disclosure pertains and which fall within the limits of the appended claims.

REFERENCE NUMBER LISTING

10 Fitness Grip
12 Exercise stretch band
14 Solid cylindrical grip element
16 Rigid inner core
18 Pliant outer molded covering
20 Textured gripping surface
22 Flange
24 Slot
26 Slotted opening
28 Gripping features
30 Retaining features

What is claimed is:

1. A fitness grip, comprising:

a solid cylindrical grip element having flanged ends and a slot with a slotted opening for receiving an exercise stretch band;

the solid cylindrical grip element being formed as one of:

a one piece monolithic solid cylindrical grip element, and a solid cylindrical rigid inner core with a pliant outer molded covering; and the one piece monolithic solid cylindrical grip element or the pliant outer molded covering being molded from 90 durometer hardness urethane rubber.

2. The fitness grip of claim 1, wherein:

the slotted opening having tooth-like gripping features for engaging the exercise band.

3. The fitness grip of claim 1, wherein:

the slot penetrates the solid cylindrical grip element at least to the centerline of the solid cylindrical grip element.

4. The fitness grip of claim 3, wherein:

the slot penetrates the solid cylindrical grip element to within ¼ inch of the surface of the solid cylindrical grip element opposite the slotted opening.

5. A fitness grip, comprising a solid cylindrical grip element having flanged ends and a slot with a slotted opening for receiving an exercise stretch band;

wherein at least one of:

retaining features adjoin the flanged ends, the retaining features being formed as hemicylindrical features that extend at least partially over the ends of the slotted opening; and the slot has ends and the flanged ends of the solid cylindrical grip element have outer faces, the ends of the slot adjoining the outer faces of the flanged ends and being provided fillet radii therebetween.

6. An exercise apparatus, comprising:

at least one exercise stretch band; and a solid cylindrical grip element having flanged ends and a slot with a slotted opening for receiving the at least one exercise stretch band;

the solid cylindrical grip element being formed as one of:

a one piece monolithic solid cylindrical grip element, and a solid cylindrical rigid inner core with a pliant outer molded covering; and the one piece monolithic solid cylindrical grip element or the pliant outer molded covering being molded from 90 durometer hardness urethane rubber.

7. The exercise apparatus of claim 6, wherein:

the slot penetrates the solid cylindrical grip element at least to the centerline of the solid cylindrical grip element.

8. The exercise apparatus of claim 7, wherein:

the slot penetrates the solid cylindrical grip element to within ¼ inch of the surface of the solid cylindrical grip element opposite the slotted opening.

9. An exercise apparatus, comprising:

at least one exercise stretch band;

a solid cylindrical grip element having flanged ends and a slot with a slotted opening for receiving the at least one exercise stretch band; and the slotted opening having tooth-like gripping features for engaging the at least one exercise band.

10. An exercise apparatus, comprising:

at least one exercise stretch band; and a solid cylindrical grip element having flanged ends and a slot with a slotted opening for receiving the at least one exercise stretch band;

wherein at least one of:

retaining features adjoin the flanged ends, the retaining features being formed as hemicylindrical features that extend at least partially over the ends of the slotted opening; and the slot has ends and the flanged ends of the solid cylindrical grip element have outer faces, the ends of the slot adjoining the outer faces of the flanged ends and being provided fillet radii therebetween.

* * * * *